US010768561B2

(12) United States Patent
Eiki et al.

(10) Patent No.: US 10,768,561 B2
(45) Date of Patent: Sep. 8, 2020

(54) FIXING DEVICE AND IMAGE FORMING APPARATUS

(71) Applicant: KYOCERA Document Solutions Inc., Osaka (JP)

(72) Inventors: Takashi Eiki, Osaka (JP); Hiroki Kawasaki, Osaka (JP); Atsushi Kohama, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/509,737

(22) Filed: Jul. 12, 2019

(65) Prior Publication Data

US 2020/0019099 A1 Jan. 16, 2020

(30) Foreign Application Priority Data

Jul. 13, 2018 (JP) ..... 2018-133243

(51) Int. Cl.
*G03G 15/20* (2006.01)
*G03G 15/00* (2006.01)

(52) U.S. Cl.
CPC ..... *G03G 15/2053* (2013.01); *G03G 15/2039* (2013.01); *G03G 15/2064* (2013.01); *G03G 15/5004* (2013.01)

(58) Field of Classification Search
CPC ..... G03G 15/2053; G03G 15/2064; G03G 15/2039; G03G 15/5004
See application file for complete search history.

(56) References Cited

U.S. PATENT DOCUMENTS

2003/0086736 A1* 5/2003 Sekiguchi ..... G03G 15/2053 399/328
2004/0265021 A1* 12/2004 Kinouchi ..... G03G 15/2042 399/334

FOREIGN PATENT DOCUMENTS

JP 2015-129789 A 7/2015

* cited by examiner

*Primary Examiner* — Hoang X Ngo
(74) *Attorney, Agent, or Firm* — Studebaker & Brackett PC

(57) ABSTRACT

A fixing device includes a cylindrical rotatable fixing belt, a flat heater, a safety device, a heater holding part and a pressuring member. The flat heater has a plurality of heat generating parts. The safety device is arranged across two adjacent heat generating parts to interrupt power supply to the heat generating parts in a case where temperature reaches a threshold value. The heater holding part holds the flat heater so that the flat heater comes into contact with an inner circumference face of the fixing belt. The pressuring member sandwiches the fixing belt with the flat heater to form a pressuring area for sandwiching and conveying a sheet between the fixing belt and the pressuring roller.

12 Claims, 7 Drawing Sheets

FIXING DEVICE AND IMAGE FORMING APPARATUS

INCORPORATION BY REFERENCE

This application is based on and claims the benefit of priority from Japanese Patent application No. 2018-133243 filed on Jul. 13, 2018, the entire contents of which are incorporated herein by reference.

BACKGROUND

The present disclosure relates to a fixing device fixing a toner image on a sheet and an image forming apparatus including this fixing device.

As one manner heating a fixing belt of a fixing device, a manner using a flat heater is known. The flat heater has a heat generating part having a longitudinal direction orthogonal to a conveying direction of a sheet, and the cylindrical fixing belt is sandwiched between the flat heater and a pressuring roller. When the pressuring roller is driven and rotated, the fixing belt is co-rotated with the pressuring roller, and the sheet on which the toner is transferred is sandwiched between the fixing belt and the pressuring roller and conveyed, and then, the toner is fixed on the sheet.

The above-mentioned heat generating part has a length corresponding to a sheet of a maximum size as a size in a direction orthogonal to the conveying direction, but in a case where a sheet with a size smaller than it is used, heat consumption of both ends in the longitudinal direction through which the sheet does not pass is decreased. Thereupon, a configuration is proposed, in which heat generating part is divided into a plurality of heat generating parts and the heat generating part according to the size of the sheet is heated. However, in a case providing a safety device (e.g. thermostat) interrupting power supply to the heat generating part when abnormal temperature rise occurs, if the safety devices are provided for each of the heat generating parts, cost is increased. Moreover, because wirings are increased, compact design is difficult.

However, in the fixing device having an above-described configuration, because the thermostat is provided only to the heating area at the center in the longitudinal direction, even if abnormal temperature rise occurs at the other heating area, power supply cannot be interrupted.

SUMMARY

In accordance with the present disclosure, a fixing device includes a cylindrical rotatable fixing belt, a flat heater, a safety device, a heater holding part and a pressuring member. The flat heater has a plurality of heat generating parts. The safety device is arranged across two adjacent heat generating parts to interrupt power supply to the heat generating parts in a case where temperature reaches a threshold value. The heater holding part holds the flat heater so that the flat heater comes into contact with an inner circumference face of the fixing belt. The pressuring member sandwiches the fixing belt with the flat heater to form a pressuring area for sandwiching and conveying a sheet between the fixing belt and the pressuring roller.

In accordance with the present disclosure, an image forming apparatus includes an image forming part forming a toner image on the sheet, and the fixing device as described above to fix the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the accompanying drawings, embodiments of an image forming apparatus and a fixing device of the present disclosure will be described.

Figure 1:
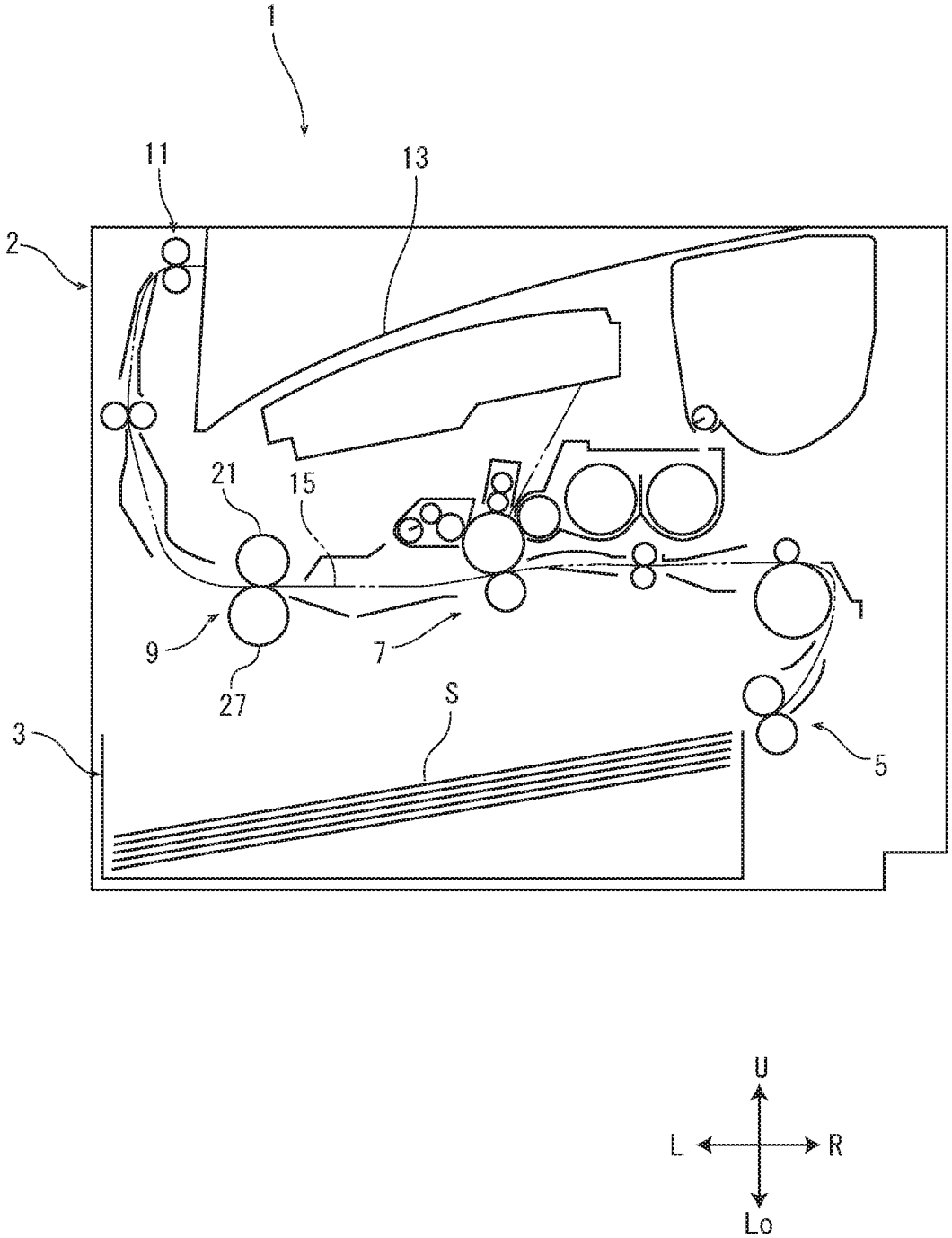
FIG. 1 is a sectional view schematically showing an internal structure of a printer according to an embodiment of the present disclosure.

First, the entire structure of a printer 1 as the image forming apparatus will be described with reference to FIG. 1. FIG. 1 is a sectional view schematically showing an internal structure of the printer 1. Hereinafter, it will be described so that the front side of the color printer 1 is positioned at a near side on a paper sheet of FIG. 1 and that left and right directions is defined as seen from the front side of the color printer 1. Arrows U, Lo, L, R, Fr and Rr in each of the drawings respectively indicate an upper side, a lower side, a left side, a right side, a front side and a rear side of the printer 1.

In an apparatus body 2 of the printer 1, a sheet feeding cartridge 3 storing sheets S, a sheet feeding device 5 feeding the sheet S from the sheet feeding cartridge 3, an image forming part 7 forming a toner image on the sheet S, a fixing device 9 fixing the toner image on the sheet S, a sheet ejecting device 11 ejecting the sheet S, and an ejected sheet tray 13 receiving the ejected sheet S are provided. Further, in the apparatus body 2, a conveying path 15 of the sheet S is arranged so as to run from the sheet feeding device 5 to the sheet ejecting device 11 through the image forming part 7 and the fixing device 9.

The sheet S fed from the sheet feeding cartridge 3 by the sheet feeding device 5 is conveyed to the image forming part 7 along the conveying path 15 and the toner image is formed on the sheet S. The sheet S is conveyed to the image fixing device 9 along the conveying path 15 and the toner image is fixed on the sheet S. The sheet S having the fixed toner is ejected from the sheet ejecting device 11 to the ejected sheet tray 13.

Figure 2:
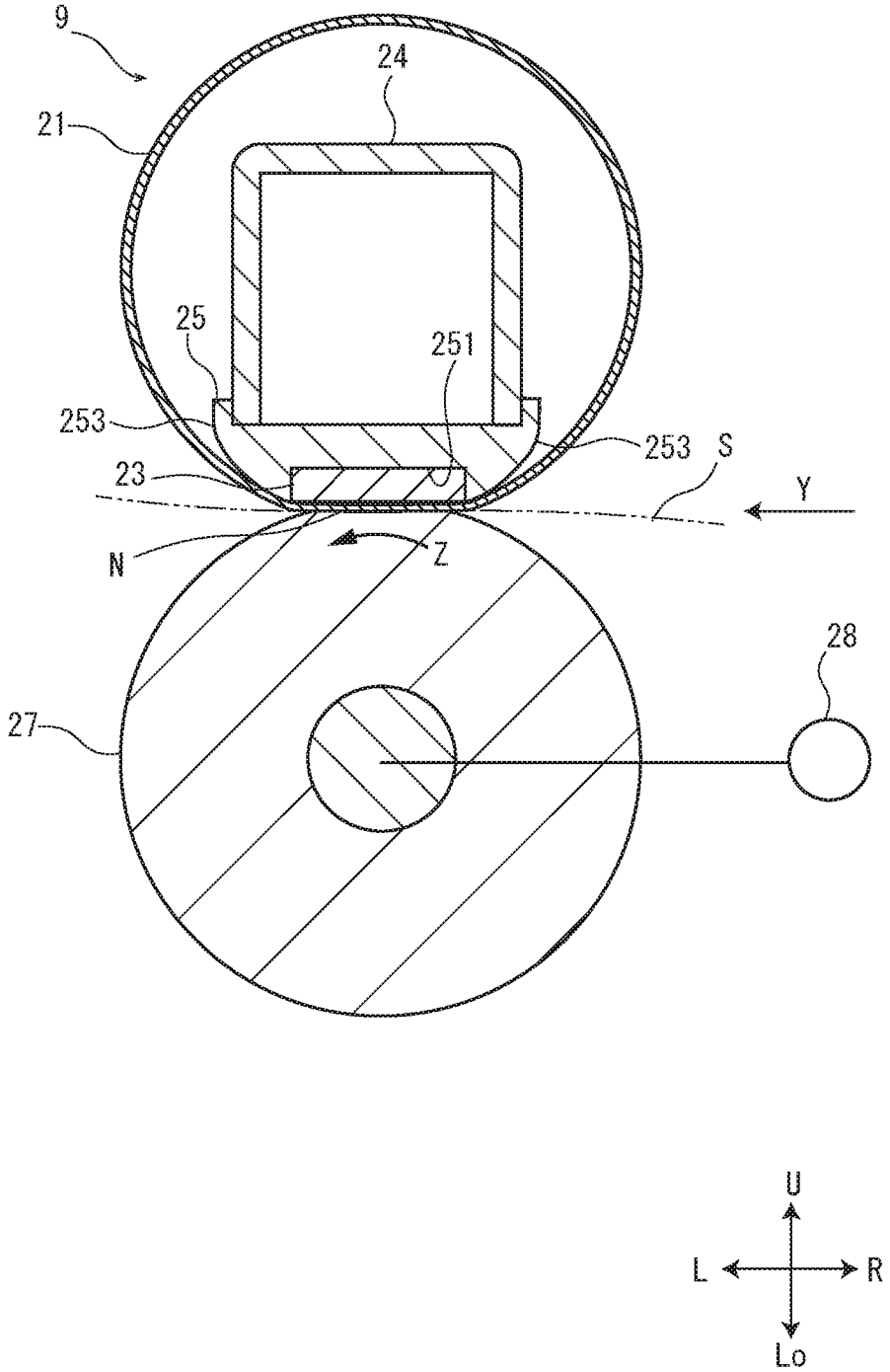
FIG. 2 is a sectional view showing a fixing device according to the embodiment of the present disclosure.

Next, the fixing device 9 will be described with reference to FIG. 2. FIG. 2 is a sectional view showing the fixing device 9. The fixing device 9 includes a cylindrical shaped rotatable fixing belt 21, a flat heater 23, thermostats 71 and 72 (an example of a safety device), a heater holding member 25 and a pressuring roller 27. The flat heater 23 has a plurality of heat generating parts 41 to 43. Each of the thermostats 71 and 72 is arranged across two adjacent heat generating parts to interrupt power supply to the heat generating parts 41 to 43 in a case where temperature reaches a threshold value. The heater holding member 25 holds the flat heater 23 so that the flat heater 23 comes into contact with an inner circumference face of the fixing belt 21. The pressuring roller 27 sandwiches the fixing belt 21 with the flat heater 23 to make the fixing belt 21 co-rotate with the pressuring roller 27. In the following description, an "axial direction X" indicates an axial direction of the pressuring roller 27 (forward and backward directions). Although, in the present embodiment, an example of the fixing device 9 arranged in a posture that the pressuring roller 27 is located below the fixing belt 21, the fixing device 9 may be arranged in any of various postures.

The fixing belt 21 is a cylindrical belt having a longitudinal direction along the axial direction X, and has a predetermined inner diameter, and its length in the longitudinal direction is longer than a width of the sheet S. The fixing belt 21 is made of material having flexibility, and has a base material layer, an elastic layer provided around an outer circumference face of the base material layer, and a release layer provided around an outer circumference face of the elastic layer. The base material layer is made of metal, such as stainless steel or nickel alloy. The elastic layer is made of silicone rubber or the like. The release layer is made of PFA tube or the like. On an inner circumference face of the base material layer, a sliding layer may be formed. The sliding layer is made of polyamide-imido, PTFE or the like.

In a hollow portion of the fixing belt 21, a pressing member 24 having a longitudinal direction along the axial direction X is penetrated, and both ends of the pressing member 24 are fixed to a housing of the fixing device 9. The pressing member 24 is made of metal, such as stainless steel or aluminum alloy. The fixing belt 21 is supported by an arc-shaped belt guide (not shown) supported by the pressing member 24, and is rotatable along the belt guide.

Figure 3:
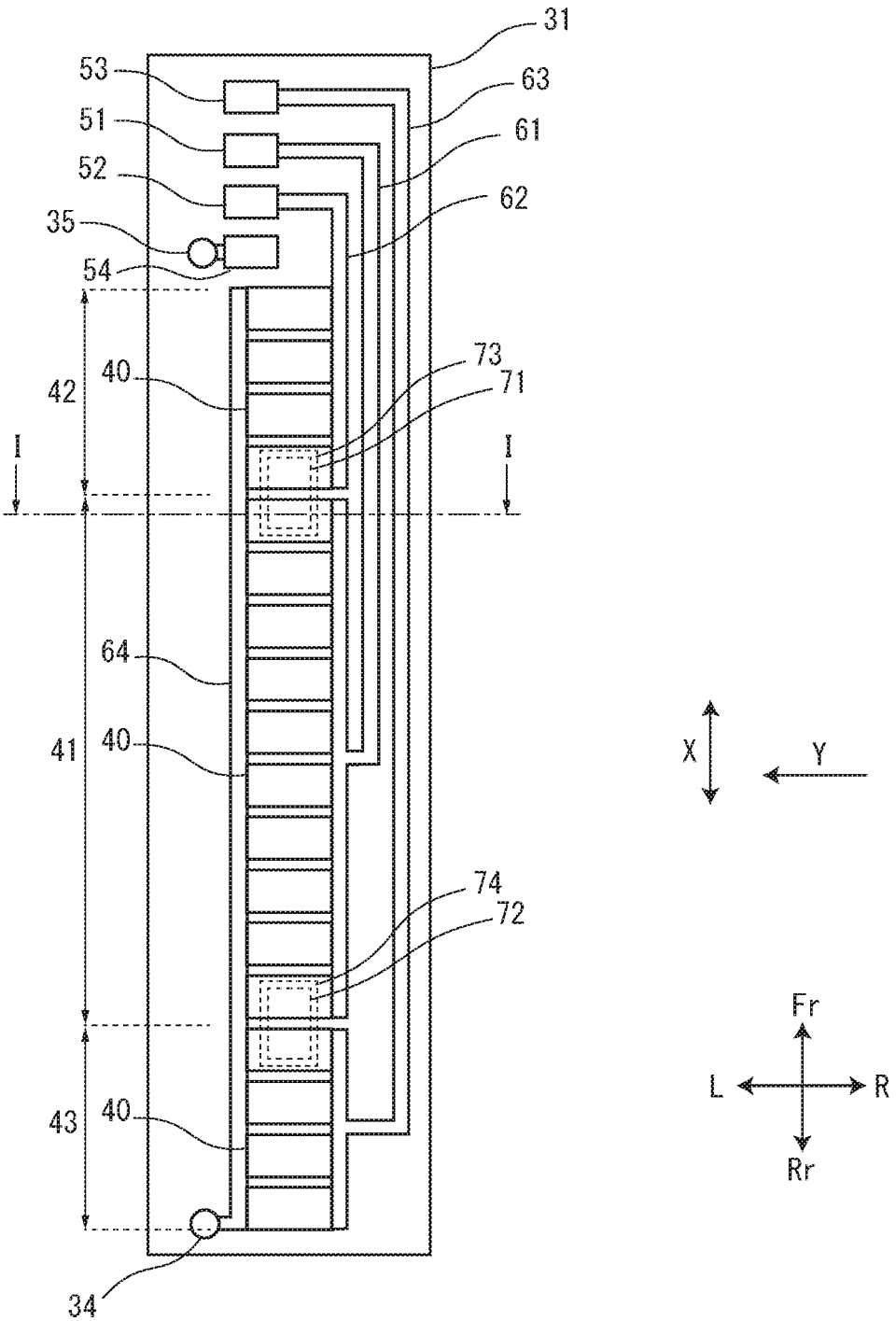
FIG. 3 is a lower face view showing a flat heater in the fixing device according to the embodiment of the present disclosure.
Figure 4:
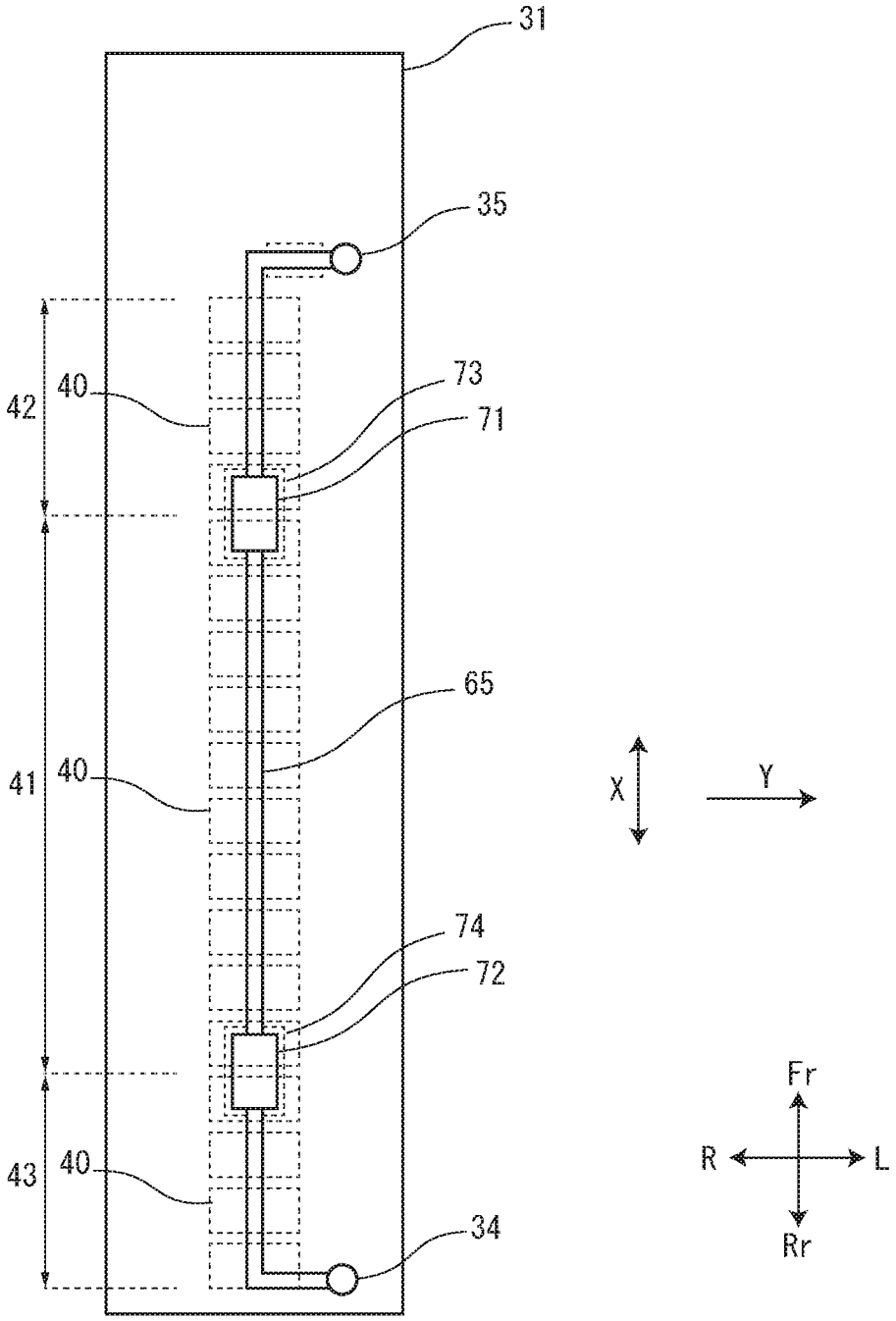
FIG. 4 is an upper face view showing the flat heater in the fixing device according to the embodiment of the present disclosure.
Figure 5:
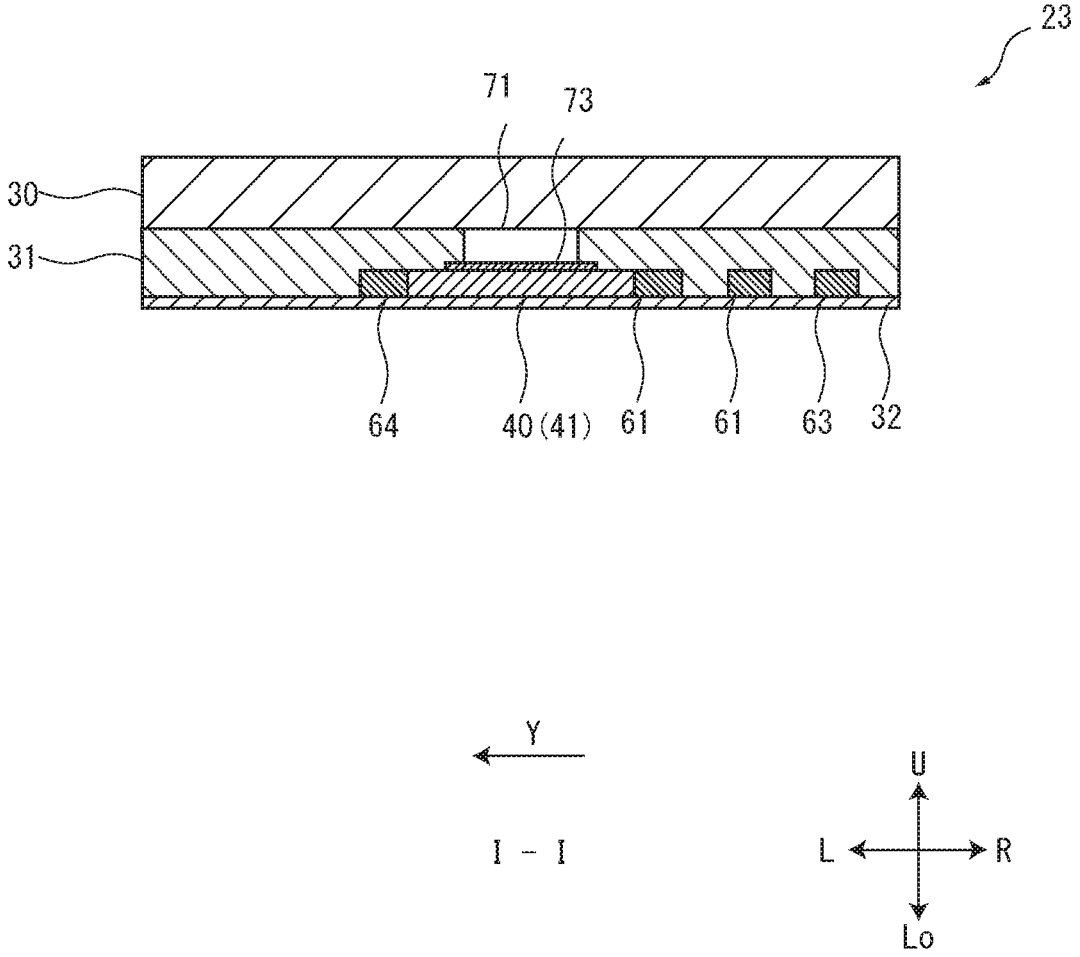
FIG. 5 is a sectional view showing the flat heater in the fixing device according to the embodiment of the present disclosure.
Figure 6:
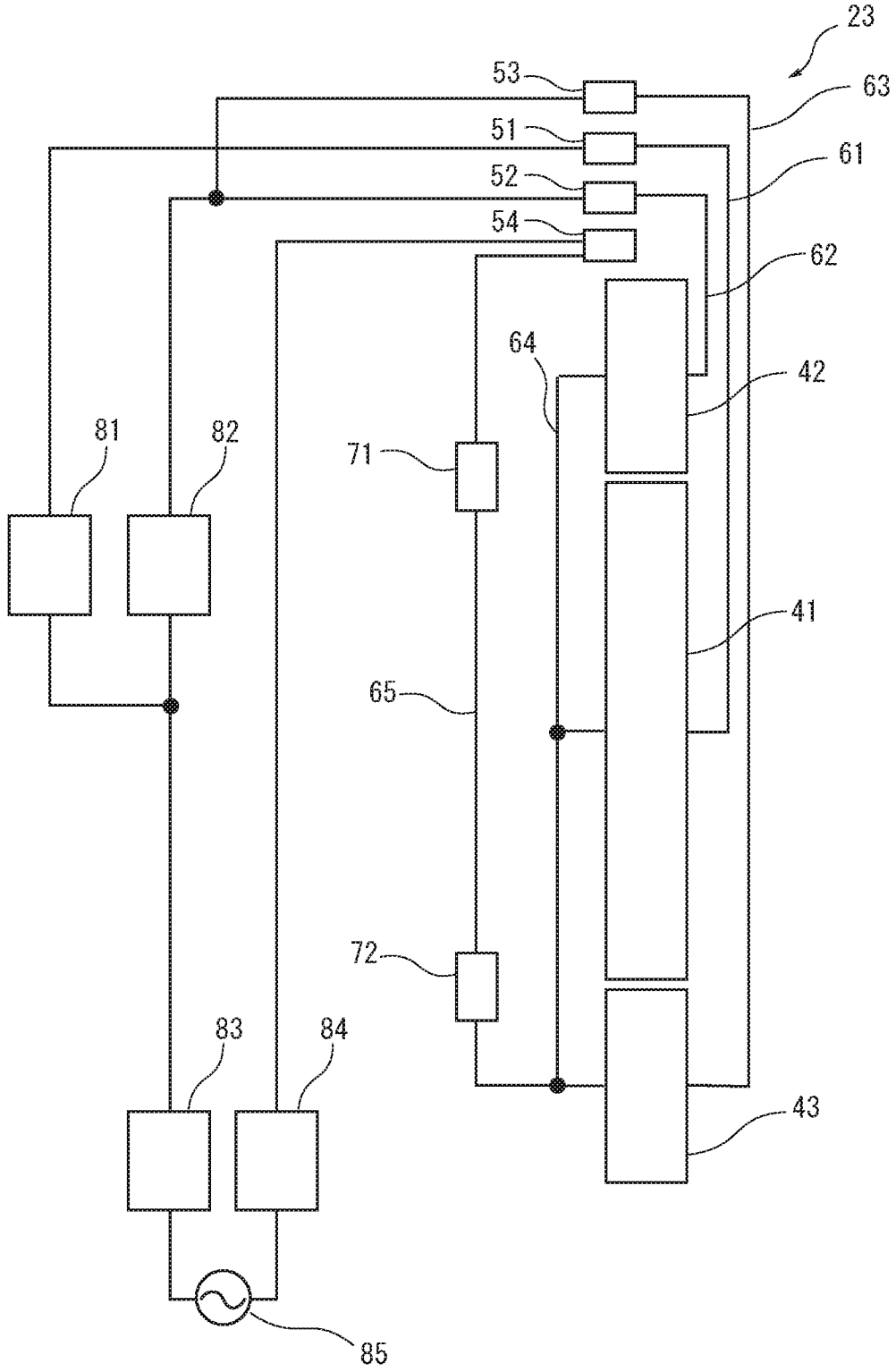
FIG. 6 is a circuit diagram showing the flat heater in the fixing device according to the embodiment of the present disclosure.

Next, with reference to FIGS. 3 to 6, a configuration of the flat heater 23 will be described. FIG. 3 is a lower face view showing the flat heater 23. FIG. 4 is an upper face view showing the flat heater 23. FIG. 5 is a sectional view along an I-I line in FIG. 3. FIG. 6 is a circuit diagram showing the flat heater 23.

The flat heater 23 is formed in a roughly rectangular plate shape having a longitudinal direction along the axial direction X. The flat heater 23 has a base material 30, a heat insulation layer 31, and a coat layer 32. Incidentally, for convenience of illustration, the coat layer 32 is omitted in FIG. 3, and the base material 30 is omitted in FIG. 4.

The base material 30 is made of material, such as ceramic, with electrical insulation property, and is formed in a roughly rectangular plate shape having a longitudinal direction along the axial direction X.

The heat insulation layer 31 is made of material, such as ceramic or glass, with electrical insulation property and low heat conductivity, and is laminated on a lower face of the base material 30. The heat insulation layer 31 restrains conducting of heat generated by the heat generating parts 41 to 43 to a side of the base material 30.

The heat generating parts 41 to 43 are made of material, such as metal, with electrical conductivity having a resistance value higher than feeders 61 to 64, and are formed on a lower face of the heat insulation layer 31. The heat generating parts 41 to 43 are arranged along one line parallel to the axial direction X. Each of the heat generating parts 41 to 43 has a plurality of resistance heat generating elements 40 arranged along one line parallel to the axial direction X.

The heat generating part 41 is arranged within a range corresponding to a length of a longer side of the sheet S of a small size (e.g. JIS A5 size). The heat generating parts 42 and 43 are arranged within a range corresponding to a length of a longer side of the sheet S of a large size (e.g. JIS A4 size) where the heat generating part 41 is not arranged. The heat generating parts 42 and 43 are respectively located at a front side and a rear side of the heat generating part 41.

The feeders 61 to 64 are made of material, such as metal, with electrical conductivity having a resistance value lower than the resistance heat generating element 40, and are formed on the lower face of the heat insulation layer 31. The feeder 61 is connected to right ends (ends at an upstream side in a conveying direction Y of the sheet S) of the plurality of resistance heat generating elements 40 included in the heat generating part 41. The feeder 62 is connected to right ends of the plurality of resistance heat generating elements 40 included in the heat generating part 42. The feeder 63 is connected to right ends of the plurality of resistance heat generating elements 40 included in the heat generating part 43. On the other hand, the feeder 64 is connected to left ends (ends at a downstream side in the conveying direction Y) of the plurality of resistance heat generating elements 40 included in the heat generating parts 41 to 43. The electrode parts 51 to 54 are located at a front side portion from the heat generating part 42 on the lower face of the heat insulation layer 31 in order of the electrode parts 53, 51, 52, 54 from the front side. The feeders 61, and 63 are respectively connected to the electrode parts 51, 52 and 53. Incidentally, on the lower face of the heat insulation layer 31, in portions in which the heat generating parts 41 to 43, the feeders 61 to 64 and the electrode parts 51 to 54 are not formed, the heat insulation layer 31 is laminated so as to form a flat face together with the heat generating parts 41 to 43, the feeders 61 to 64 and the electrode parts 51 to 54.

The coat layer covers a range in the longitudinal direction of the heat insulation layer 31 where the heat generating parts 41 to 43 are formed. The coat layer is made of, for example, material, such as ceramic, with electrical insulation property and small sliding friction force with respect to the fixing belt 21. A lower face of the coat layer comes into contact with the inner circumference face of the fixing belt 21.

As shown in FIGS. 4 and 5, the thermostat 71 is arranged across an upper face of the heat generating part 41 and an upper face of the heat generating part 42. The thermostat 72 is arranged across an upper face of the heat generating part 41 and an upper face of the heat generating part 43. Each of the thermostats 71 and 72 has, for example, a switch using a bimetal to interrupt power supply by deforming the bimetal when temperature of the bimetal is risen by thermal conduction from the outside to reach the threshold value. The thermostats 71 and 72 are connected in series by the feeder 65.

As shown in FIGS. 4 and 5, in a rear end of the heat insulation layer 31, a through hole 34 is formed and, near the electrode part 54 of the heat insulation layer 31, a through hole 35 is formed. The feeder 64 is connected to one end of the feeder 65 via the through hole 34 and the other end of the feeder 65 is connected to the electrode part 54 via the through hole 35.

A heat conduction member 73 is connected between the thermostat 71 and the heat generating parts 41 and 42. A heat conduction member 74 is connected between the thermostat 71 and the heat generating parts 41 and 43. Each of the heat conduction members 73 and 74 has an area larger than an area of each of the thermostats 71 and 72 facing to the heat generating parts 41 to 43. The heat conduction members 73 and 74 are sheet-shaped members, such as copper, aluminum or graphite, having high heat conductivity to promote heat conduction from the heat generating parts 41 to 43 to the thermostats 71 and 72 as the safety device. Between the thermostats 71 and 72 and the heat conduction members 73 and 74, fluorine grease for promoting heat conduction is applied.

As shown in FIG. 6, to the electrode part 51, a triac 81 is connected and, to the electrode parts 52 and 53, a triac 82 is connected. The triacs 81 and 82 are connected to one terminal of an AC power source 85 via a relay 83. The electrode 54 is connected to the other terminal of the AC power source 85 via a relay 84.

The triacs 81 and 82 control power supply from the AC power source to the heat generating parts 41 to 43 in accordance with the size of the sheet. In a case of the sheet of the small size, the triac 81 supplies power to the heat generating part 41, and thereby, the heat generating part 41 generates heat. In a case of the sheet of the large size, the triac 81 supplies power to the heat generating part 41 and the triac 82 supplies power to the heat generating parts 42 and 43, and thereby, the heat generating parts 41 to 43 generate heat.

As shown in FIG. 2, the heater holding member 25 holds the flat heater 23 so that the flat heater 23 comes into contact with the inner circumference face of the fixing belt 21. The heater holding member 25 is a member having the same length as a width X in the axial direction X of the fixing belt 21. The heater holding member 25 is made of, for example, heat resistant resin, such as liquid crystal polymer. The heater holding member 25 is supported by the pressing member 24. In a lower portion of the heater holding member 25, a recessed portion 251 having a longitudinal direction along the axial direction X is formed. The flat heater 23 is fitted into the recessed portion 251 in a posture that the coat layer is positioned at a lower side. The heater holding member 25 has curved portions 253 with curvature slightly larger than curvature of the fixing belt 21, and the curved portions 253 and the flat heater 23 compose a smooth face along the inner circumference face of the fixing belt 21.

The pressuring roller 27 has a core metal, an elastic layer provided around an outer circumference face of the core metal, and a release layer provided around an outer circumference face of the elastic layer. The elastic layer is made of silicon rubber or the like. The release layer is made of PFA tube or the like. The pressuring roller 27 sandwiches the fixing belt 21 with the flat heater 23 to form a pressuring area N between the fixing belt 21 and the pressuring roller 27. The pressuring roller 27 is driven by a motor 28 to make the fixing belt 21 co-rotate with pressuring roller 27, and sandwiches and conveys the sheet S.

A fixing operation of the fixing device 9 having the above-described configuration will be described. When the pressuring roller 27 is driven and rotated in a predetermined rotating direction Z, the fixing belt 21 is co-rotated with the pressuring roller 27 in an opposite rotating direction to the rotating direction Z of the pressuring roller 27, and the inner circumference face of the fixing belt 21 is slide with respect to the flat heater 23. When power is supply to the heat generating parts 41 to 43 of the flat heater 23, the heat generating parts 41 to 43 generate heat to heat the fixing belt 21. After temperature of the fixing belt 21 reaches predetermined temperature, the sheet S on which the toner is transferred is conveyed to the pressuring area N. In the pressuring area N, the sheet S is sandwiched between the fixing belt 21 and the pressuring roller 27 and conveyed. At this time, the toner is heated and pressured by the fixing belt 21, and them, the toner is fixed on the sheet S. The sheet S on which the toner is fixed is separated from the fixing belt 21 and conveyed along the conveying path 15.

Here, in a case where any of the triacs 81 and 82 is broken down to disable control of power supply, abnormal temperature rise occurs in the heat generating part 41, 42 or 43 connected to the broken-down triac 81 or 82. In a case where temperature of the thermostat 71 or 72 risen by heat conduction from the heat generating part 41, 42 or 43 due to abnormal temperature rise reaches the threshold value, the thermostat 71 or 72 interrupts power supply to the heat generating part 41, 42 or 43. For instance, if the triac 81 is broken down, abnormal temperature rise occurs in the heat generating part 41, and then, if temperature of the thermostat 71 or 72 reaches the threshold value, the thermostat 71 or 72 with temperature reaching the threshold value interrupts power supply to the heat generating part 41, 42 or 43. On the other hand, if the triac 82 is broken down, abnormal temperature rise occurs in the heat generating parts 42 and 43, and then, if temperature of the thermostat 71 or 72 reaches the threshold value, the thermostat 71 or 72 with temperature reaching the threshold value interrupts power supply to the heat generating part 41, 42 or 43.

Figure 7:
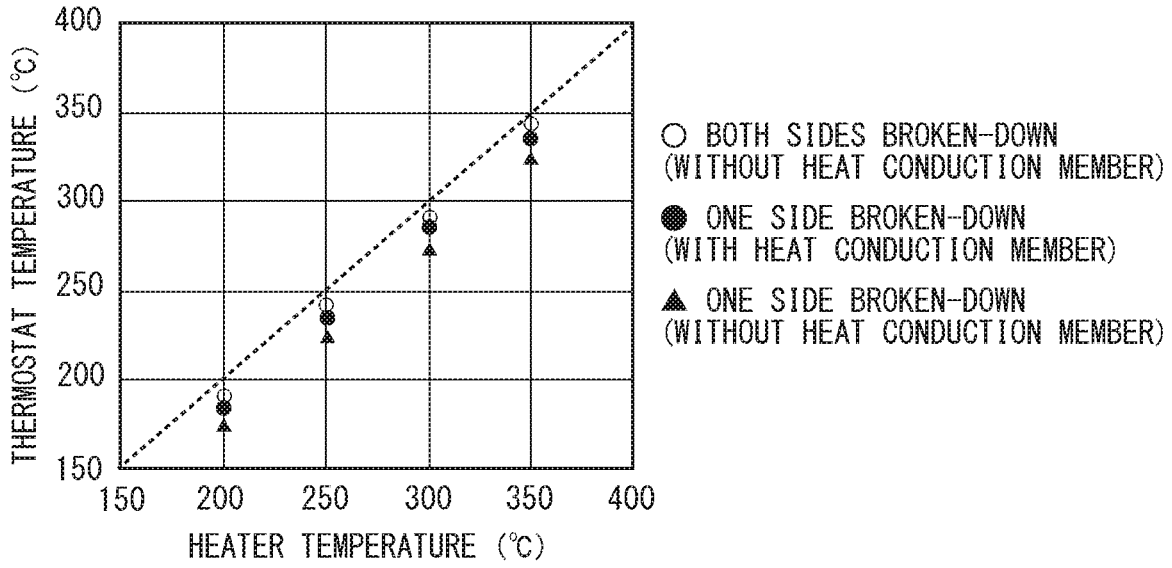
FIG. 7 is a graph plotting results of temperature rise test of the flat heater in the fixing device according to the embodiment of the present disclosure.

Next, with reference to FIG. 7, effect of the present embodiment will be described. FIG. 7 is a graph plotting results of temperature rise test of the flat heater 23. Heater temperature of a horizontal axis is temperature of the flat heater 23 and thermostat temperature of a vertical axis is temperature of the thermostat 71. White dots indicate results simulating a case of both sides broken-down, i.e. a case where both the triacs 81 and 82 are broken down and the heat generating parts 41 and 42 fall into abnormal temperature rise. While stepwisely increasing power supply to the heat generating parts 41 and 42, temperature of heat generating parts 41 and 42 and temperature of the thermostat 71 are measured, and temperature of the thermostat 71 is plotted whenever temperature of heat generating part 41 or 42 is 200, 250, 300 or 350 degrees centigrade. However, in this case, the heat conduction member 73 is not provided. Black triangles indicate results simulating a case of one side broken-down, i.e. a case where the triac 81 is broken down and the heat generating part 41 falls into abnormal temperature rise. In this case, similarly, the heat conduction member 73 is not provided. Black dots indicate results simulating a case where the heat conduction member 73 is provided and one side is broken down.

Firstly, in comparison with the case of both sides broken-down (without the heat conduction member) and the case of one side broken-down (without the heat conduction member), although thermostat temperature is comparatively close to heater temperature in the case of both sides broken-down, thermostat temperature is lower by 20 to 25 degrees centigrade than heater temperature in the case of one side broken-down. This is caused because, by rising temperature of both of the heat generating parts 41 and 42 in the case of both sides broken-down, on the other hand, by rising temperature of both of the heat generating part in the case of one side broken-down, heat quantity conducted to the thermostat 71 in the case of one side broken-down is small in comparison with the case of both sides broken-down. It is considered that thermostat temperature in the case of both sides broken-down is close to thermostat temperature in a case where the thermostat is provided for each heat generating part and broken-down occurs. Therefore, in the present embodiment, although thermostat temperature is slightly lowered in comparison with the case where the thermostat is provided for each heat generating part, it is considered that sufficient accuracy can be achieved for practical use.

On the other hand, a difference between thermostat temperature and heater temperature in the case of one side broken-down (with the heat conduction member) is restrained by approximately 10 degrees centigrade, and the difference between thermostat temperature and heater temperature is small in comparison with the case without the heat conduction member. It is considered that this result is caused because heat conduction from the heat generating parts 41 and 42 to the thermostat 71 is promoted by the heat conduction member 73.

As described above, in accordance with the present embodiment, even if the flat heater 23 having the plurality of heat generating parts 41, 42 and 43 in the longitudinal direction does not include the thermostat 71 or 72 arranged for each of the heat generating parts 41, 42 and 43, it is possible to interrupt power supply in abnormal temperature rise occurs in any of the heat generating parts 41, 42 and 43.

Moreover, in accordance with the present embodiment, since the heat conduction member 73 or 74 promotes heat conduction from the heat generating part 41, 42 or 43 to the thermostat 71 or 72, it is possible to improve accuracy of temperature of the thermostat 71 or 72. Further, in accordance with the present embodiment, in comparison with a case where the heat conduction member 73 or 74 has the same area as the area of each of the thermostats 71 and 72 facing to the heat generating parts 41 to 43, since a large quantity of heat is conducted from the heat generating part 41, 42 or 43 to the thermostat 71 or 72, it is possible to further improve accuracy of temperature of the thermostat 71 or 72.

In a modified example, as the safety device instead of the thermostats 71 and 72 using the bimetal, thermostats using shape memory alloy may be applied. Alternatively, in a modified example, as the safety device instead of the thermostats 71 and 72, fuses may be applied.

Although, in the present embodiment, an example that the flat heater 23 has three heat generating parts 41, and 43 is described, the present disclosure may be applied in a case where the flat heater 23 has two heat generating parts or four or more heat generating parts.

Although, in the present embodiment, a case where the present disclosure is applied to the printer 1 has been described as one example, the disclosure is not restricted by this, but may be applied to a copying machine, a facsimile, a multifunction peripheral or the like.

The above-description of the embodiment of the present disclosure was described about a preferable embodiment of the fixing device and the image forming apparatus according to the disclosure. However, the technical scope of the present disclosure is not limited to the embodiments.

The invention claimed is:

1. A fixing device comprising:

a cylindrical rotatable fixing belt;

a flat heater having a plurality of heat generating parts;

a safety device arranged across two adjacent heat generating parts to interrupt power supply to the heat generating parts in a case where temperature reaches a threshold value;

a heater holding part holding the flat heater so that the flat heater comes into contact with an inner circumference face of the fixing belt; and a pressuring member sandwiching the fixing belt with the flat heater to form a pressuring area for sandwiching and conveying a sheet between the fixing belt and the pressuring roller, wherein between the two adjacent heat generating parts and the safety device, a sheet-shaped heat conduction member promoting heat conduction from the heat generating part to the safety device is provided.

2. The fixing device according to claim 1, wherein the heat conduction member has an area larger than an area of the heat conduction member facing to the heat generating parts.

3. An image forming apparatus comprising:

an image forming part forming a toner image on the sheet; and the fixing device according to claim 2 to fix the toner image on the sheet.

4. The fixing device according to claim 1, wherein the flat heater includes an electrode part connected to a predetermined power source, the safety device is provided between the heat generating part and the electrode part via a predetermined feeder.

5. An image forming apparatus comprising:

an image forming part forming a toner image on the sheet; and the fixing device according to claim 4 to fix the toner image on the sheet.

6. The fixing device according to claim 1, wherein the safety device is composed of a thermostat using a bimetal.

7. An image forming apparatus comprising:

an image forming part forming a toner image on the sheet; and the fixing device according to claim 6 to fix the toner image on the sheet.

8. The fixing device according to claim 1, wherein the safety device is composed of a thermostat using shape memory alloy.

9. An image forming apparatus comprising:

an image forming part forming a toner image on the sheet; and the fixing device according to claim 8 to fix the toner image on the sheet.

10. The fixing device according to claim 1, wherein the safety device is composed of a fuse.

11. An image forming apparatus comprising:

an image forming part forming a toner image on the sheet; and the fixing device according to claim 10 to fix the toner image on the sheet.

12. An image forming apparatus comprising:

an image forming part forming a toner image on the sheet; and the fixing device according to claim 1 to fix the toner image on the sheet.

* * * * *